US010718548B1

(12) United States Patent
Hart et al.

(10) Patent No.: US 10,718,548 B1
(45) Date of Patent: Jul. 21, 2020

(54) AIR RETURN ASSEMBLY HAVING A RETRACTABLE GRILLE

(71) Applicants: Betty F. Hart, Odessa, FL (US); Jack Mace, Jr., Laurel Hill, FL (US)

(72) Inventors: Betty F. Hart, Odessa, FL (US); Jack Mace, Jr., Laurel Hill, FL (US)

( * ) Notice: Subject to any disclaimer, the term of this patent is extended or adjusted under 35 U.S.C. 154(b) by 0 days.

(21) Appl. No.: 16/740,029

(22) Filed: Jan. 10, 2020

(51) Int. Cl.
*F24F 13/28* (2006.01)
*F24F 13/32* (2006.01)
*F24F 3/16* (2006.01)

(52) U.S. Cl.
CPC ..... *F24F 13/28* (2013.01); *F24F 3/1603* (2013.01); *F24F 13/32* (2013.01); *F24F 2221/14* (2013.01)

(58) Field of Classification Search
CPC ..... F24F 13/28; F24F 13/32; F24F 3/1603; F24F 2221/14
USPC ... 55/385.1, 385.2, 493, 494, 495, 480, 504, 55/502, 508, 511, 516, 518, DIG. 31; 454/309, 328, 337
See application file for complete search history.

(56) References Cited

U.S. PATENT DOCUMENTS 3,780,503 A * 12/1973 Smith ..... B01D 46/12 55/418
4,713,099 A * 12/1987 Schroeder ..... B01D 46/10 55/385.1
5,094,676 A * 3/1992 Karbacher ..... B01D 50/00 416/146 R
5,525,145 A * 6/1996 Hodge ..... B01D 46/001 96/17
2009/0165432 A1* 7/2009 Yabu ..... F24F 1/0007 55/415
2013/0199142 A1* 8/2013 Kerr, Jr. ..... F24F 13/28 55/493
2013/0212991 A1* 8/2013 Albert ..... F24F 13/20 55/385.2
2015/0096271 A1* 4/2015 Cole ..... B01D 46/4227 55/385.2
2016/0045850 A1* 2/2016 Swenerton ..... F24F 3/1603 96/399

* cited by examiner

*Primary Examiner* — Minh Chau T Pham
(74) *Attorney, Agent, or Firm* — Smith & Hopen, P.A.; Steven M. Forte

(57) ABSTRACT

The present invention includes an air return grille assembly adapted to be installed within an air return opening disposed within a ceiling, the air return opening having a first perimeter. The air return housing includes a frame establishing a housing channel. A flange is configured to restrict an air filter from being disposed through the frame. A retraction mechanism is coupled to a portion of the lateral wall of the air return housing and configured to transition the grille from a first position to a second position. When in the first position an air filter is disposed between the grill and the flange such that air flowing through the air return opening is filtered by the air filter. In the second position, the grille is disposed away from the air return housing and configured to permit the safe removal and replacement of the air filter.

20 Claims, 10 Drawing Sheets

AIR RETURN ASSEMBLY HAVING A RETRACTABLE GRILLE

BACKGROUND OF THE INVENTION

1. Field of the Invention

This invention relates, generally, to air ventilation grilles. More specifically, it relates to air returns having a retractable grille for home and commercial air conditioning systems.

2. Brief Description of the Prior Art

As the average age of the United. States population continues to increase, the number of homeowners capable of performing routine home maintenance continues to decline. Unfortunately, the aging population is forced to make the difficult choice of giving up their autonomy, selling their home, or living in unsafe homes. In certain situations, homeowners are forced to pay a handyman to come out to their home and perform routine maintenance. This can end up costing homeowners hundreds or thousands of dollars each year during a time when the aging population is increasingly reliant on a limited fixed income.

The removal and replacement of air return filters are an everyday home maintenance tasks that become increasingly difficult and dangerous to perform as the age of the homeowner increases. Routine air filter replacement is critical for the maintenance, performance, comfort, and health of the home's occupants. Proper air quality is maintained by taking unfiltered air within the home, passing it through an air filter, and returning the filtered air to the home through the homes central air conditioning (A/C) system. Air filters serve to remove dust, debris, and harmful pathogens from the air circulating within the home, and manufactures typically recommend that air filters be replaced every 1-3 months. Furthermore, having clean and filtered air circulating within the home is even more critical for the elderly who are most susceptible to illness and least likely to be able to perform this common maintenance task on their own.

Typically, return air filters are recessed high up in the ceiling of a home and out of the reach of the typical homeowner. As a result, homeowners are reliant on ladders, scaffolding, and other furniture to extend their reach and provide themselves access to remove and replace the return air filters. According to the Centers for Disease Control, an estimated 500,000 people in the United States are treated, and about 300 people die from ladder-related injuries costing the United States $24 billion in work loss, medical, legal, and pain and suffering each year. The present invention will prevent a number of these injuries and deaths.

Accordingly, what is needed is an air return having a retractable grille, thereby providing homeowners with a safe and reliable way of ensuring clean, filtered air circulating throughout their home. However, in view of the art considered as a whole at the time the present invention was made, it was not obvious to those of ordinary skill in the field of this invention how the shortcomings of the prior art could be overcome.

All referenced publications are incorporated herein by reference in their entirety. Furthermore, where a definition or use of a term in a reference, which is incorporated by reference herein, is inconsistent or contrary to the definition of that term provided herein, the definition of that term provided herein applies and the definition of that term in the reference does not apply.

While certain aspects of conventional technologies have been discussed to facilitate disclosure of the invention, Applicants in no way disclaim these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing, but heretofore unfulfilled need for retractable air ventilation grilles is now met by a new, useful, and nonobvious invention.

The novel structure includes an air return grille assembly adapted to be installed within an air return opening having a first perimeter. The air return grille assembly comprises an air return housing and a grille. The air return housing includes a frame that establishes a housing channel and comprises a second perimeter sized smaller than the perimeter of the air return opening. The frame includes a first end, a second end, and a lateral wall extending therebetween. The frame is configured to be at least partially disposed within the air return opening. In an embodiment, the first end resides within a first plane, and a second end resides within a second parallel plane.

A flange extends inwardly from at least a portion of the lateral wall toward a centroid of the frame and is configured to restrict an object (e.g., an air filter) from being disposed fully through the air return opening. In an embodiment, the flange is discontinuous with the lateral wall. The flange may include an aperture disposed through the flange. A retraction mechanism is coupled to a portion of the lateral wall between the first end and the flange. The retraction mechanism includes an attachment portion coupled to a grille, such that the grille is configured to transition between a first position and a second position upon exceeding the biasing force of the retraction mechanism which biases the retraction mechanism toward the first position.

In an embodiment, a second flange extends inwardly from at least a portion of the lateral wall toward the centroid of the frame. The second flange is disposed between the first flange and the second end of the air return housing and configured to abut the grille when in the first position. In such an embodiment, the second flange includes a magnet coupled to a surface of the second flange and is magnetically attracted to the grille when the grille is in the first position. The second flange is configured to extend toward the centroid of the frame at a distance less than the distance the first flange extends toward the centroid.

The grille includes a grille member having a third perimeter sized smaller than the second perimeter of the housing channel. The grille member includes a first surface, a second surface, and a body extending therebetween. A slot is disposed through the body from the first surface to the second surface and configured to permit airflow therethrough. The grille is at least partially received within the housing channel when in the first position, ensuring that the air filter is secured between the grille and the flange of the air return housing.

The second surface of the grille includes a first attachment mechanism configured to couple to a second attachment mechanism of a tool, such that when a user couples the tool to the grille and exerts a downward force in a direction away from the air return grille assembly, the grille is transitioned from the first position to the second position. In an embodiment, the grille includes a trim piece extending outwardly from the grille member and is configured to abut a surface of the ceiling when in the first position. Trim piece includes a gasket disposed about the perimeter of the trim piece and provides an airtight seal between the surface of the ceiling and the trim piece. The gasket ensures that air flowing within the air return grille assembly flows through slots disposed within the grille and filtered by the air filter, rather than flowing around the air filter.

These and other important objects, embodiments, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

Figure 1A:
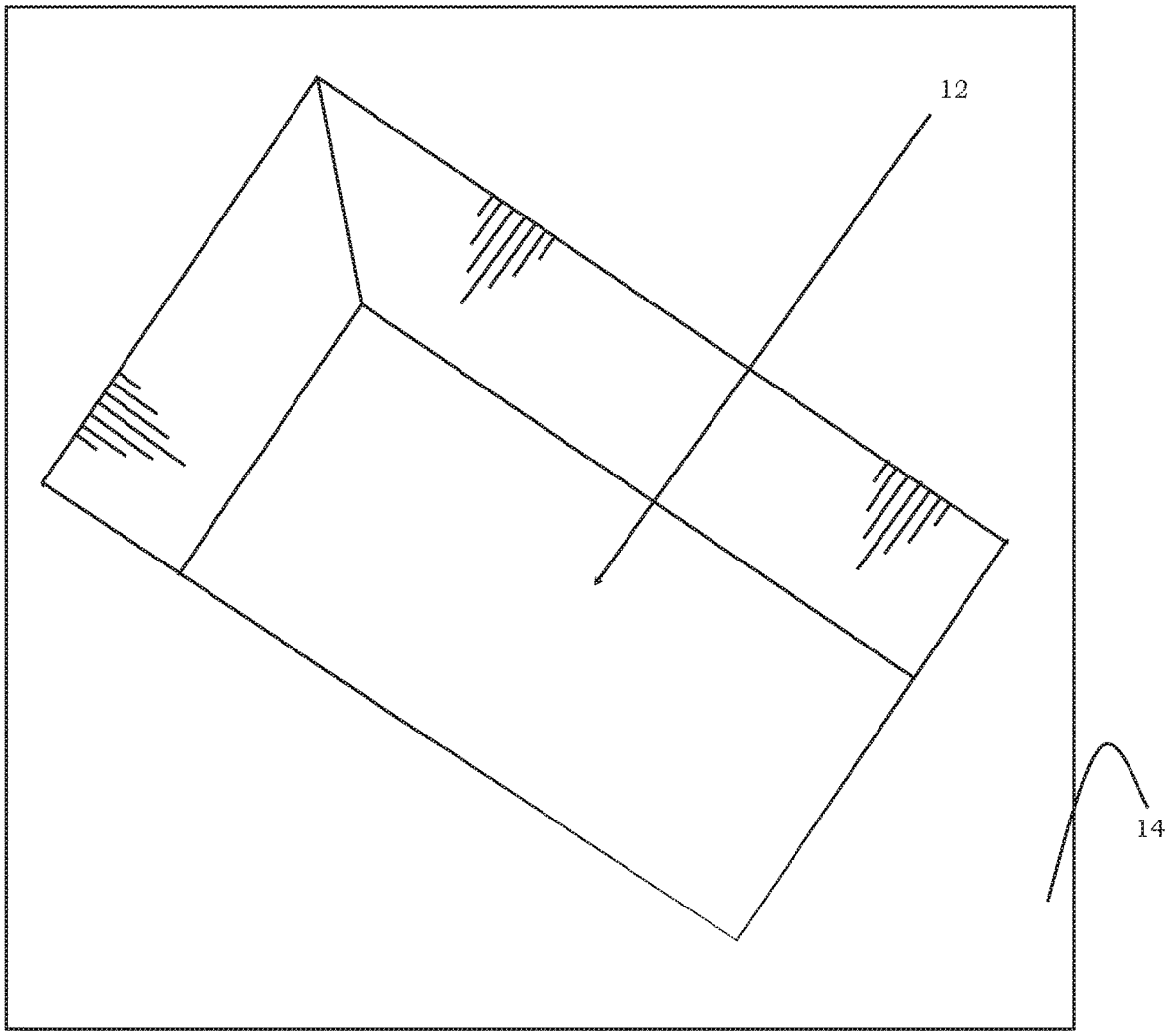
FIG. 1A is a perspective view of an air return opening within the ceiling of a structure.
Figure 1B:
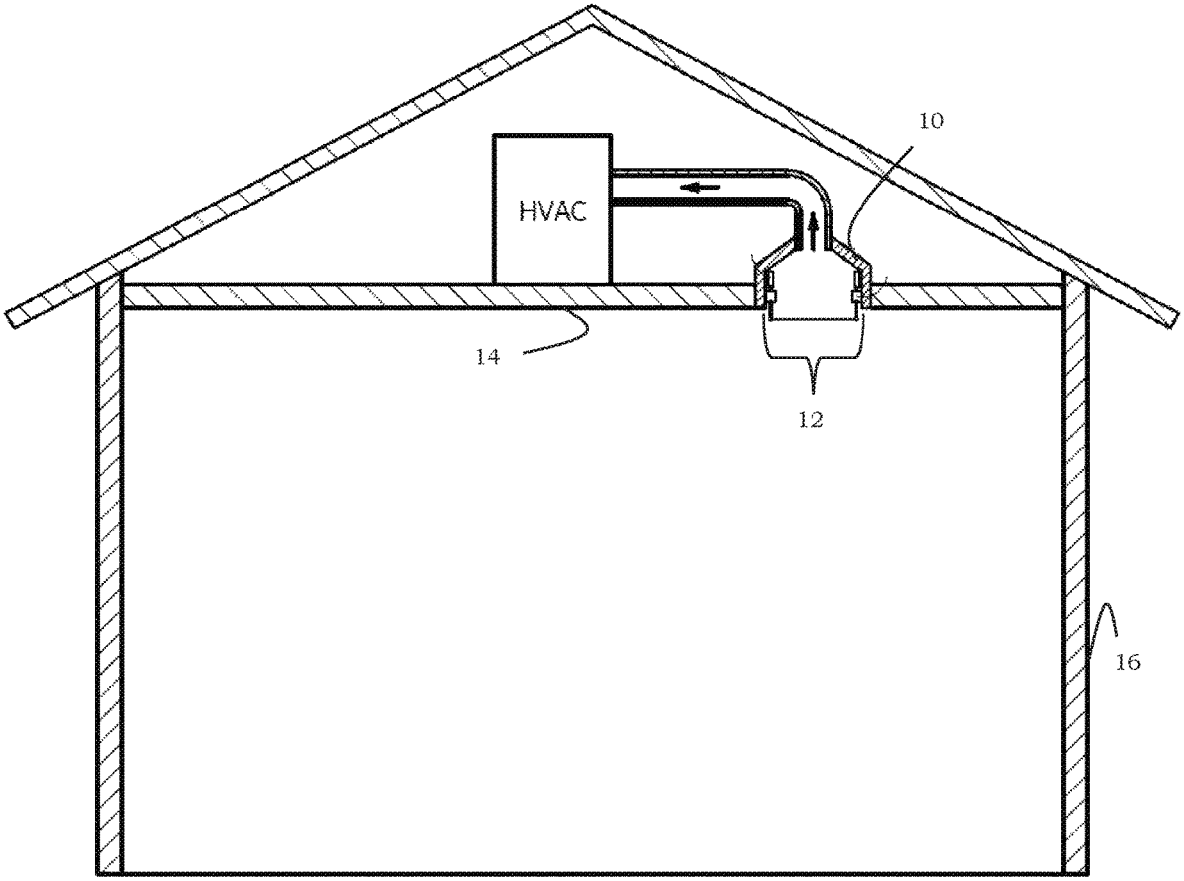
FIG. 1B depicts air return assembly installed within the ceiling of a structure.

In the following detailed description of the preferred embodiments, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

As used in this specification and the appended claims, the singular forms "a," "an," and "the" include plural referents unless the content clearly dictates otherwise. As used in this specification and the appended claims, the term "or" is generally employed in its sense including "and/or" unless the context clearly dictates otherwise.

The present invention includes an air return grille assembly. The air return assembly comprises an air return housing and a grille. The grille and filter are configured to transition between a first position and a second position, such that a user can remove and replace the air filter. The air filter is disposed between the grille and a flange of the air return housing, such that when the grille is in the second position, the air filter provides a user with easy access for the removal and replacement of the air filter without having to resort to using dangerous ladders or standing on unstable furniture to perform routine home maintenance.

Referring initially to FIGS. 1A-1B and 4A-4B, air return grille assembly (hereinafter "return assembly") 10 includes air return opening (hereinafter "return opening") 12 formed within ceiling 14 of structure 16 having a first perimeter edge defining a first cross-sectional geometric shape, e.g., rectangular shape. Return assembly 10 is adapted. to be installed within return opening 12 to permit the safe removal and replacement of air filter 18. When in the first position, as shown in FIG. 5A, air filter 18 is secured within return assembly 10. Upon transitioning of air return 10 to the second position—by exceeding the biasing force of retraction mechanism 20—air filter 18 lowered to a predetermined height from the ground, thereby exposing air filter 18 to a user for the removal and replacement of air filter 18.

Figure 2A:
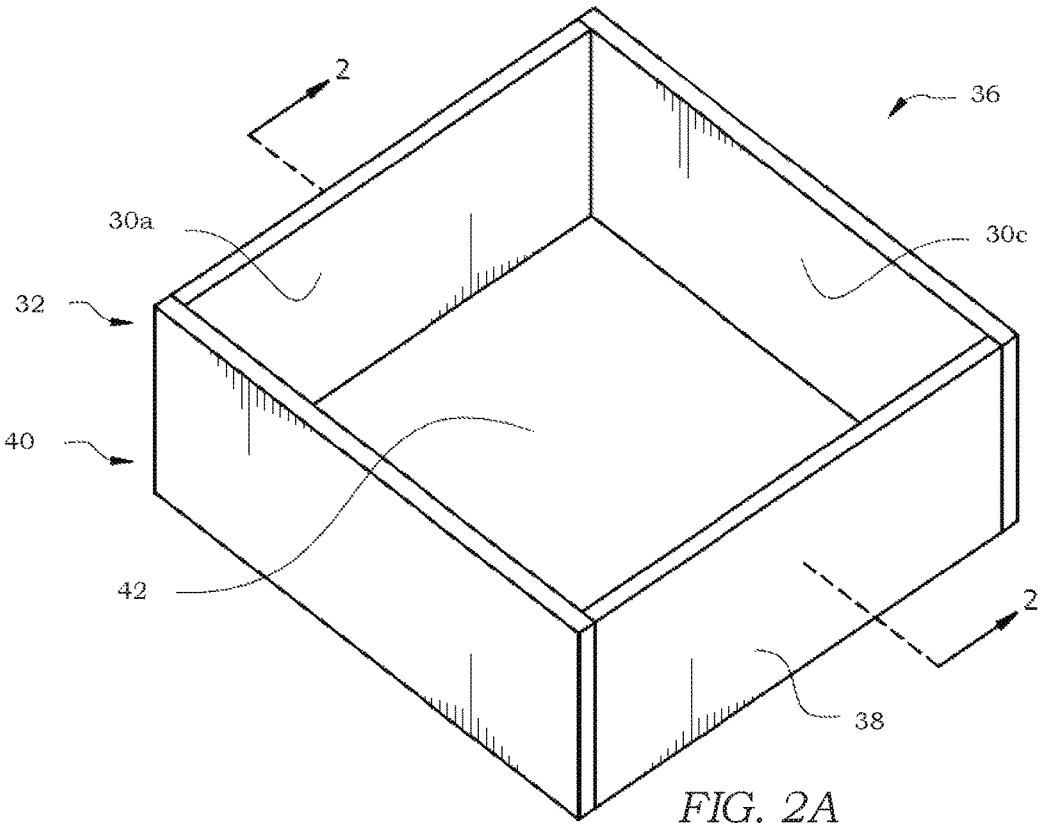
FIG. 2A is a perspective view of an air return assembly frame.
Figure 2B:
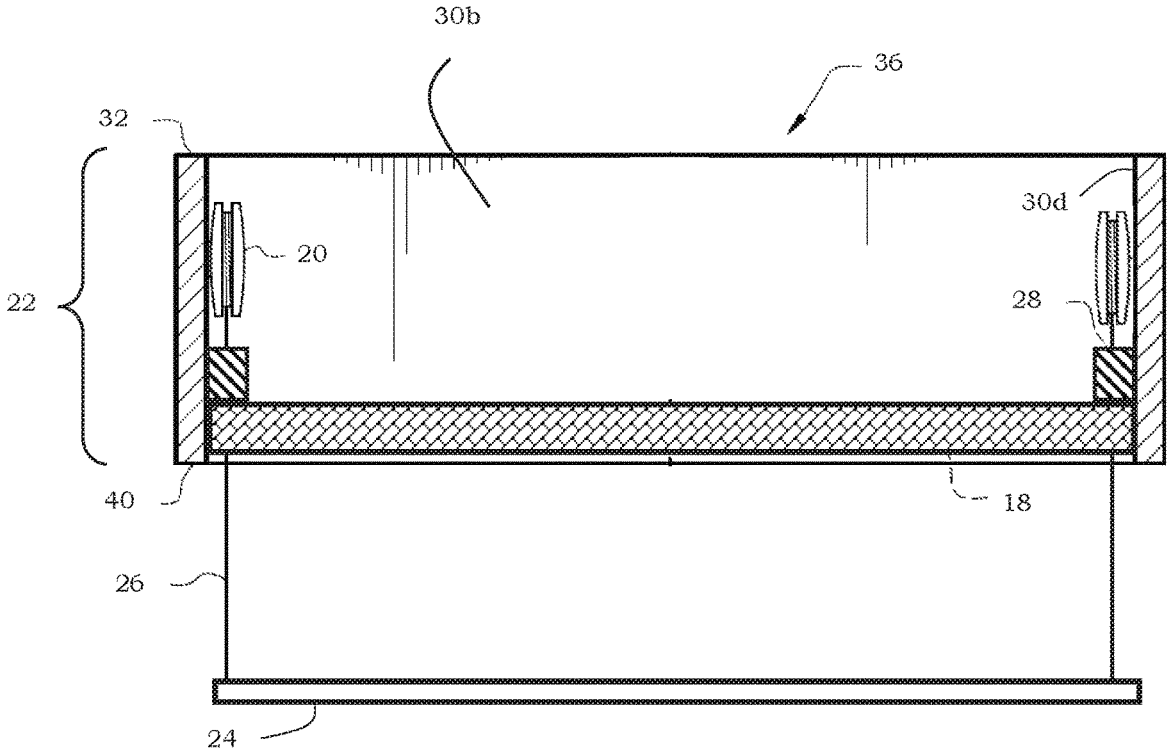
FIG. 2B is a cross-sectional view of an air return assembly taken along line 2-2 in FIG. 2A.
Figure 2C:
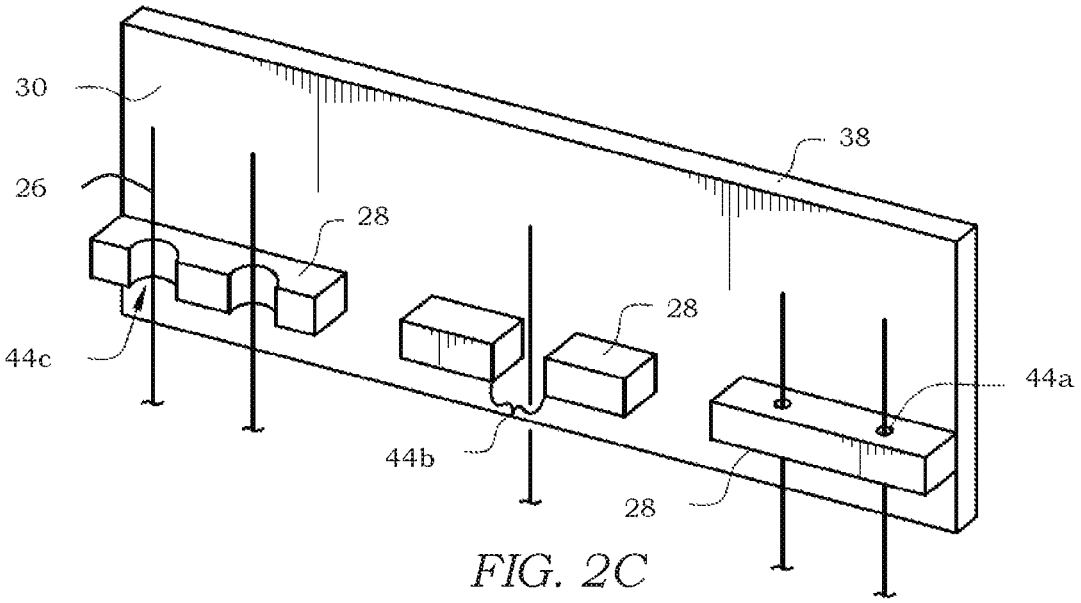
FIG. 2C depicts various embodiments of pass-throughs disposed through a flange.

FIGS. 2A-2C depicts return assembly 10 comprising return housing 22 and grille 24 in mechanical communication with one another via link 26 of retraction mechanism 20. Links 26 may be a wire, cord, chain, rope, tether, or other devices linking return housing 22 with grille 24. Air filter 18 is disposed between grille 24 and flange 28 and configured to filter contaminated or dirty air received from the internal environment within structure 16. Retraction mechanisms 20 transition return assembly 10 from the first position to a second position to provide access to air filter 18 disposed therein.

Retraction mechanisms 20 are coupled to at least a portion of lateral interior surfaces 30 of lateral wall 38 between first end 32 and flange 28. Retraction mechanisms 20 are biased to the first position, and as a result, to transition return assembly 10 from the first position to the second position, a user must exert a downward force away from return housing 22, such that the downward force exceeds the biasing force of retraction mechanisms 20. Retraction mechanisms 20 may be a retractable reel, retractable pully, winch, tension reel, elastic chord, compliant mechanism, or other mechanisms capable of transitioning grille 24 from the first position to the second position. In an embodiment, retraction mechanisms 20 may be electrically powered and/or controlled remotely. Links 26 of retraction mechanisms 20 are configured to couple to at least a portion of grille 24 using coupling mechanisms 34, such as swivels, cable seals, cable hooks, j-hooks, and/or adhesive.

Return housing 22 may be constructed through an injection molding process or formed from a single piece of pressed metal. In an embodiment, return housing 22 may be formed of acrylonitrile-butadiene-styrene (ABS), polyvinylchlodde (PVC), wood, metal, metal alloy, or other suitable material for constructing return housing 22. Further, return housing 22 may be constructed in separate pieces and then assembled on-site, such as during the building or renovation process of structure 16 for easy installation in new and preexisting structures 16. Return housing 22 is secured within return opening 12 using fasteners, such as a screw, nail, adhesive, clamp, nut and bolt combination, or other methods known in the art to secure frame 36 to a support within ceiling 14 (e.g., roofing truss).

Referring further to FIGS. 2A-2C, plurality of lateral walls 38 extend between first end 32 and second end 40 of frame 36. First end 32 may reside within a first plane and second end 40 may reside within a second plane, such that the first plane and the second plane are parallel. Frame 36 includes a second perimeter defining a second cross-sectional geometric shape sized slightly smaller than the first cross-sectional geometric shape of air return opening 12. Frame 36 further includes two sets of lateral interior surfaces 30 in an orthogonal relationship with one another. The first set includes first side 30*a* opposite second side 30*b*, and the second set includes third side 30*c* opposite fourth side 30*d*. Housing channel 42 extends between each lateral interior surfaces 30 from first end 32 to second end 40.

Flange 28 extends inwardly toward housing channel 42 from at least one of the lateral interior surfaces 30 toward a centroid of frame 36. Flange 28 prevents air filter 18 from being disposed through housing channel 42 and may be discontinuous or continuous. Pass-throughs 46 disposed within or formed integrally with flange 30 are configured to permit link 24 to pass-through flange 30 unobstructed. Pass-throughs 44 maybe be in the form of apertures 44*a*, spacing 44*b*, notch 44*c*, or combinations thereof. In an embodiment flange 28 is an air duct collar.

Figure 3:
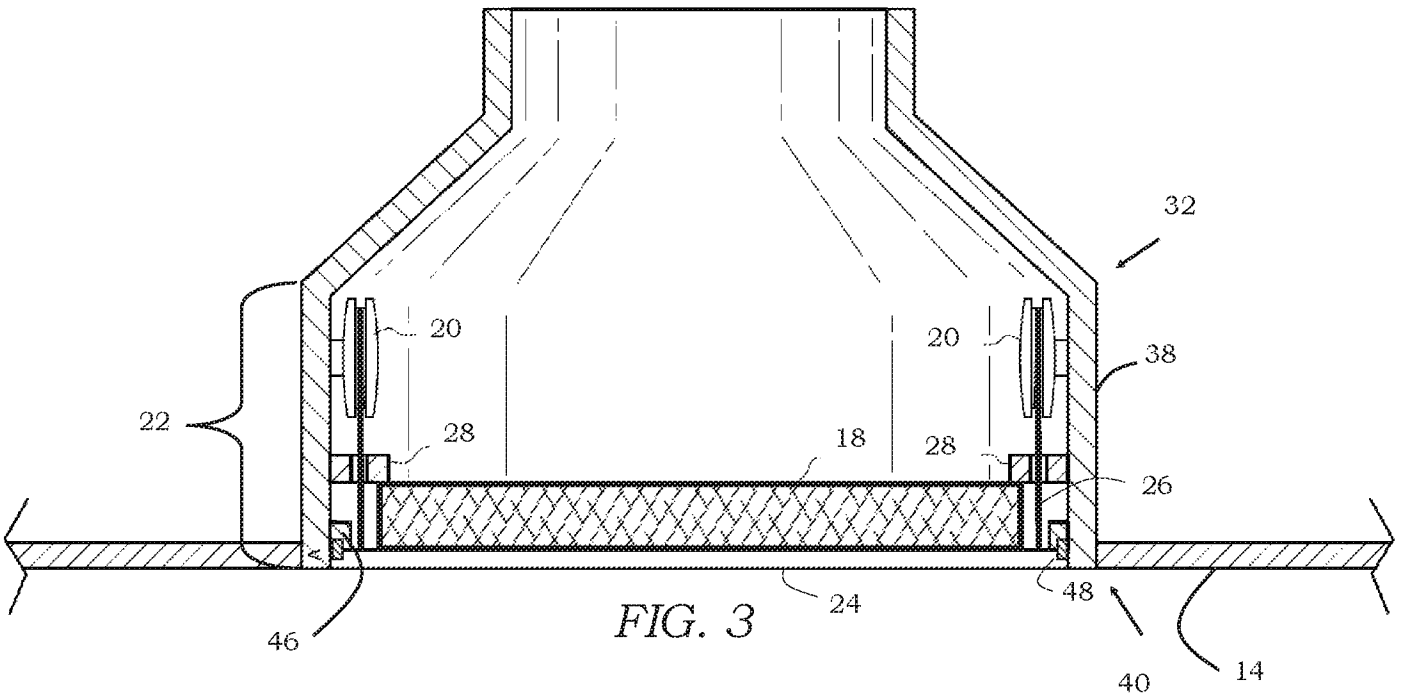
FIG. 3 depicts an embodiment of a cut-away view of an air return assembly in the first position.

FIG. 3 depicts an embodiment in which second flange 46 extends inwardly from at least a portion of lateral interior surfaces 30 toward the centroid of frame 36. Disposed between first flange 28 and second end 40, second flange 46 is configured to abut grill 24 when grille 24 is in the first position, thereby restricting the movement of air filter 18 within return housing 22. In an embodiment, magnets 48 may be coupled to the surface of second flange 46 and magnetically attract grille 24 when in the second position, thereby further securing grille 24 within return housing 22. In such embodiment, to transition grille 24 from the first position to the second position, a user must also exceed the magnetic attraction of magnets 48, along with that of the biasing force of retraction mechanisms 20.

Figure 4A:
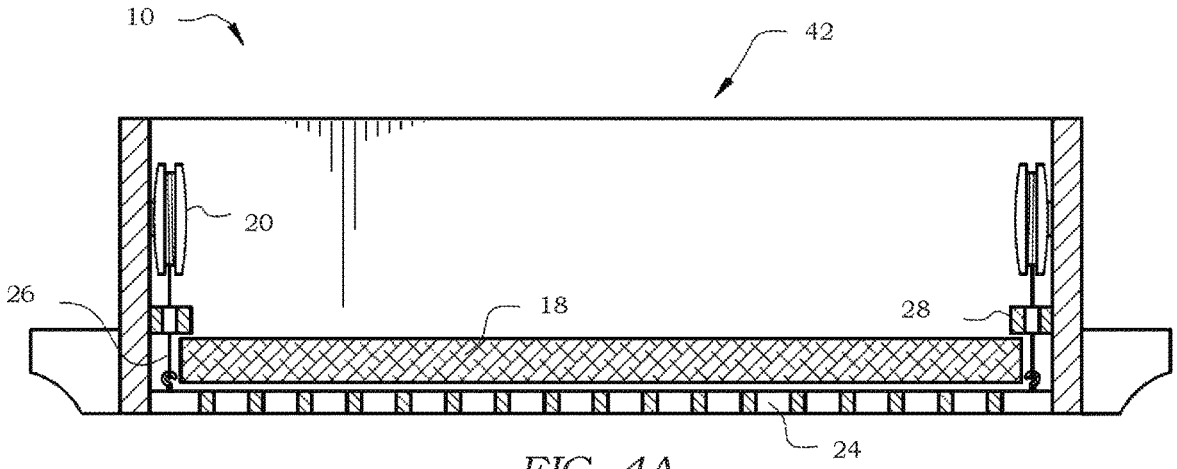
FIG. 4A depicts a cut-away view of an air return assembly in the first position.
Figure 4B:
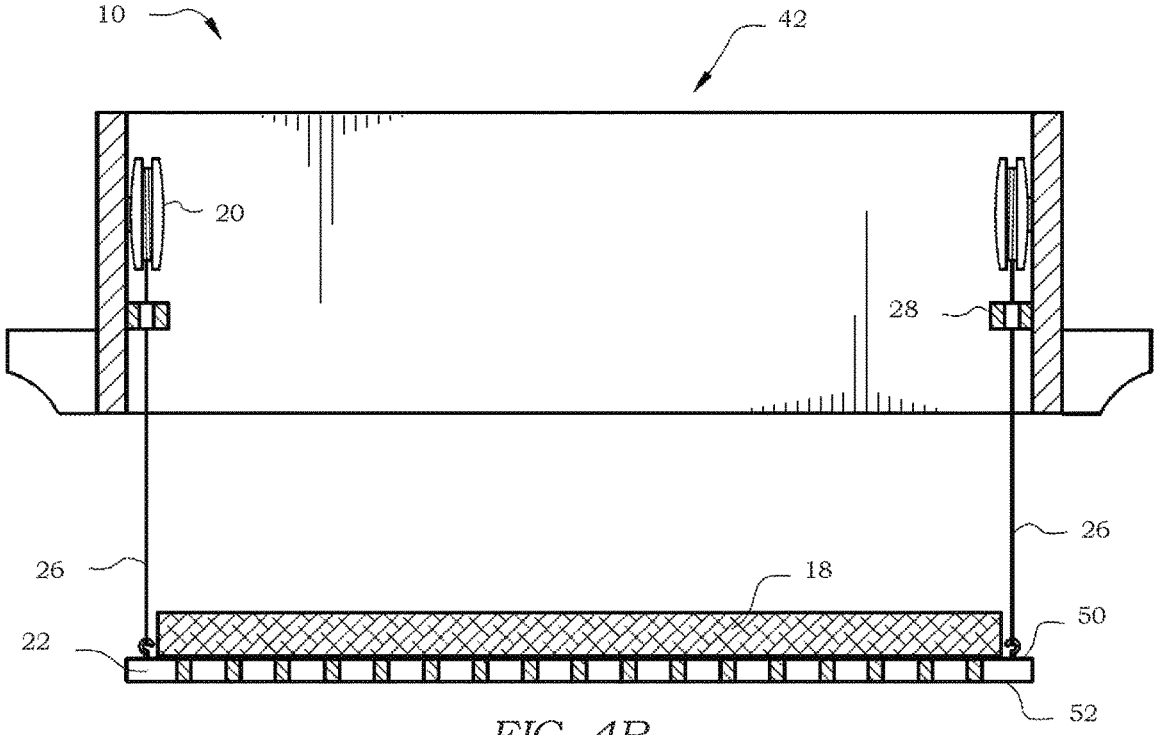
FIG. 4B depicts a cut-away view of an air return assembly in the second position.
Figure 5A:
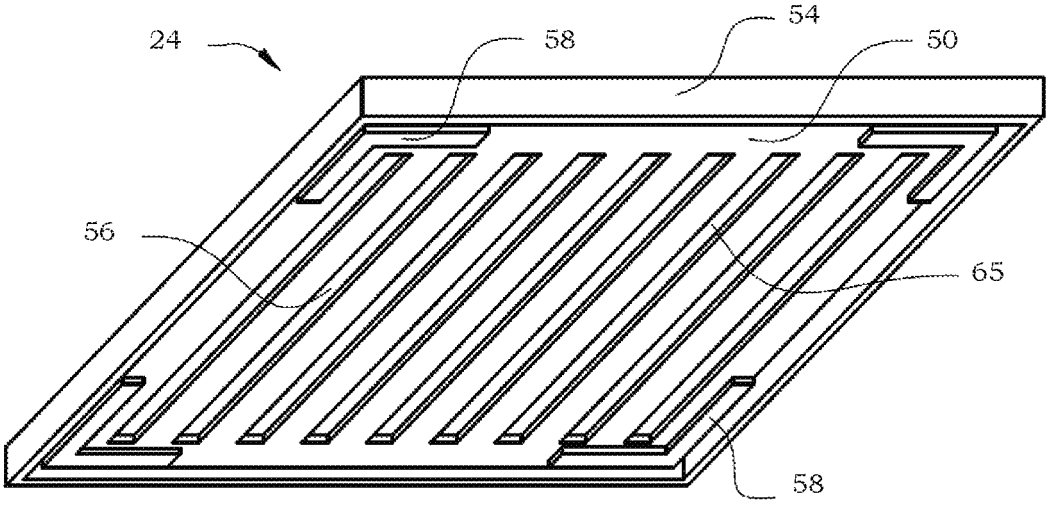
FIG. 5A depicts a perspective view of the first surface of the grille.

When in the first position, as depicted in FIG. 4A, grille 24 is unretracted and received within air return housing 22. When it is time to service air filter 18, typically every 1-3 months, a user transitions grille 24 from the first position to the second position depicted in FIG. 4B. When in the second position, grille 24 is disposed away from frame 36, exposing air filter 18 to a user at ground for easy and safe removal and replacement. The second position provides a user access to air filter 18 disposed between grille 24 and air return housing 22 without the user being required to stand on ladders or other objects. Once air filter 18 is removed and replaced, the user then transitions grille 24 from the second position to the first position by reducing or eliminating the downward force being applied.

Figure 5B:
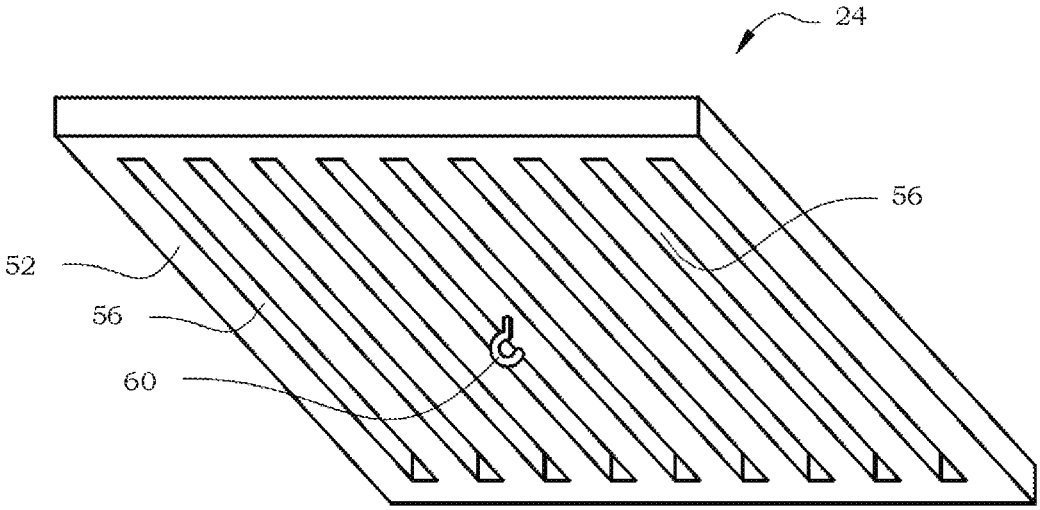
FIG. 5B depicts a perspective view of the second surface of the grille.

As depicted in FIGS. 5A and 5B, grille 24 includes a third perimeter defining a third cross-sectional geometric shape sized slightly smaller than the second cross-sectional geometric shape of frame 36. The size and shape of grille 24 in relation to the size and shape of frame 36 permit grille 24 to be at least partially secured within frame 24 when in the first position. Grille 24 includes first surface 50, second surface 52, and body 54 extending between first surface 50 and second surface 52. Slots 56 extend through body 54 of grille 24 from first surface 50 to second surface 52. Slots 56 ensure that air flowing from the interior of structure 16 passes through air filter 18 disposed between grille 24 and flange 28, such that the air is filtered and cleaned before being returned to the interior of structure 16. In an embodiment, first surface 50 includes extensions 58 designed to secure air filter 18 to first surface 50 and prevent air filter 18 from being displaced when transitioning grille 24 and air filter 18 from the first to the second position and vice versa. Second surface 52 of grille 24 includes first attachment mechanism 60 configured to couple to second attachment mechanism 62 of tool 64 shown in FIG. 6.

Figure 6:
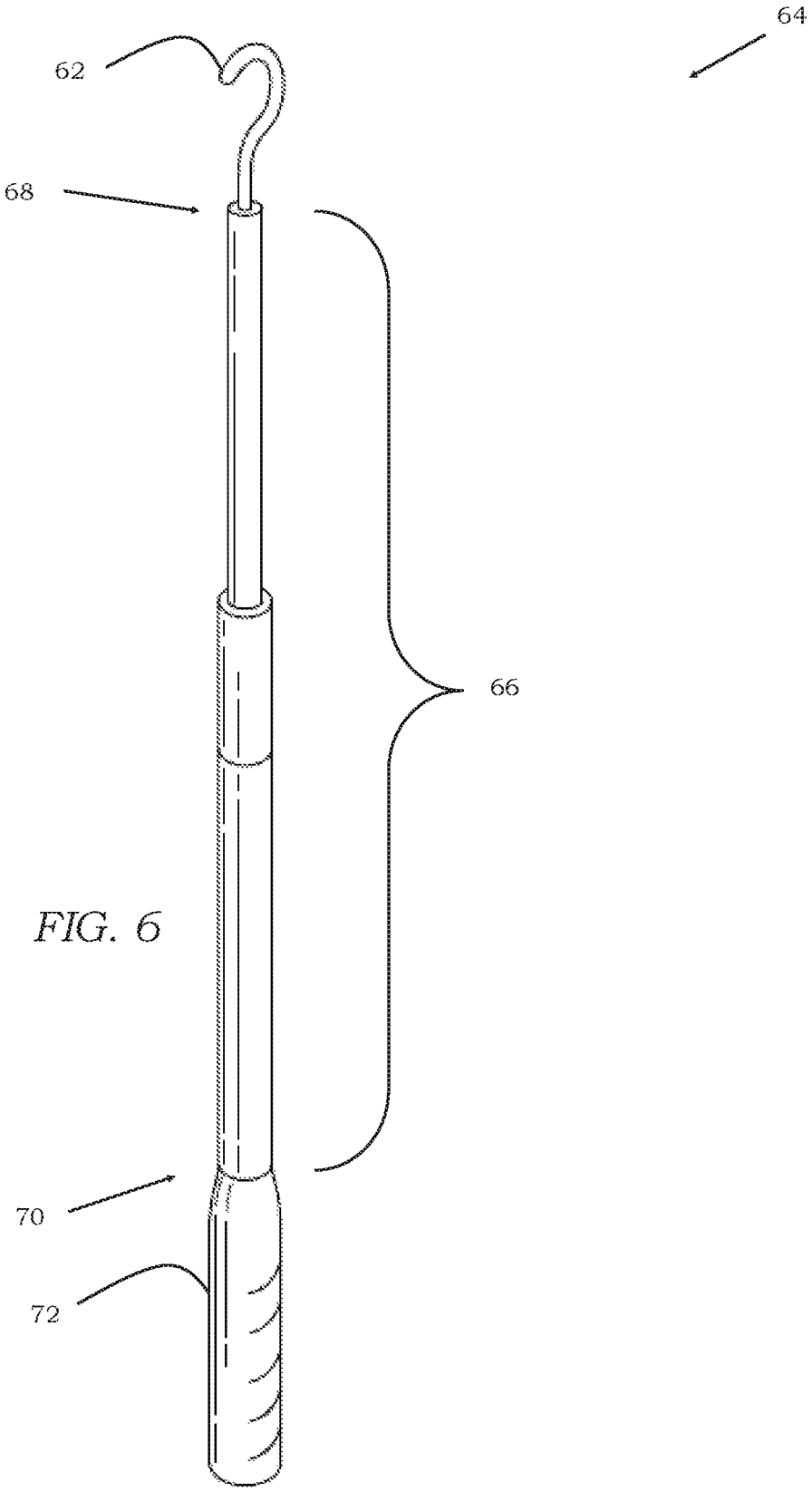
FIG. 6 depicts a tool used to couple to the first attachment mechanism of the second surface of the grille.

FIG. 6 depicts tool 64 having shaft 66 extending along a central longitudinal axis from proximal end 68 to distal end 70. In an embodiment, shaft 66 may include a bore, such that tool 64 is hollow. Shaft 66 can have various cross-sectional geometries such as square, rectangular, or hexagonal. Shaft 66 can be formed from aluminum, plastic, stainless steel, copper, bronze, brass, galvanized steel, carbon fiber, acrylonitrile-butadiene-styrene (ABS), polyvinylchloride (PVC), or other suitable material that one of ordinary skill in the art would appreciate. Tool 64 includes grip 72 disposed at proximal end 68 to grasp tool 64 during use securely. Grip 72 may be formed integrally with or secured to tool 64 by adhesive, fasteners, clamps, threaded engagements, or any other method known in the art to secure grip 72 to shaft 66. Distal end 70 of tool 64 includes second attachment mechanism 62 configured to be releasably coupled to first attachment mechanism 60. In an embodiment, tool 64 may be a telescopic shaft 66.

The coupling of first attachment mechanism 60 to second attachment mechanism 62 permits a user to safely and easily transition grille 24 between the first position and the second position without the need for a ladder or furniture to provide the extra reach—especially for taller ceilings or hallways. Further, tool 64 allows for users with fine motor skill disabilities or arthritis to easily transition return housing 10 from the first position to the second position as using sliders, knobs, or screws of conventional air return vent covers may aggravate or prevent the user having certain medical conditions from opening and closing conventional air return vent covers.

Figure 7A:
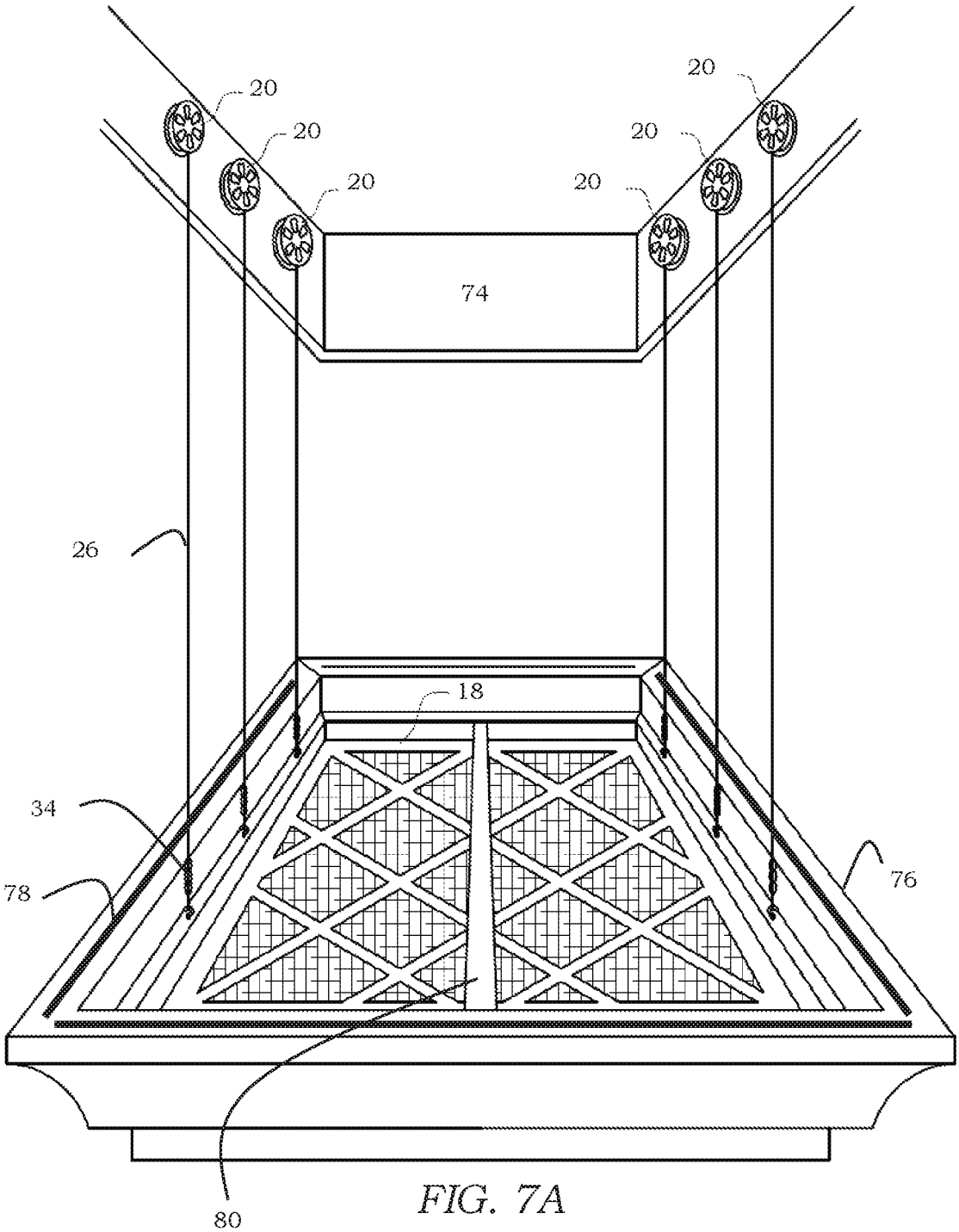
FIG. 7A depicts a perspective view of an embodiment of the air return assembly in the second position when secured within an existing air duct.
Figure 7B:
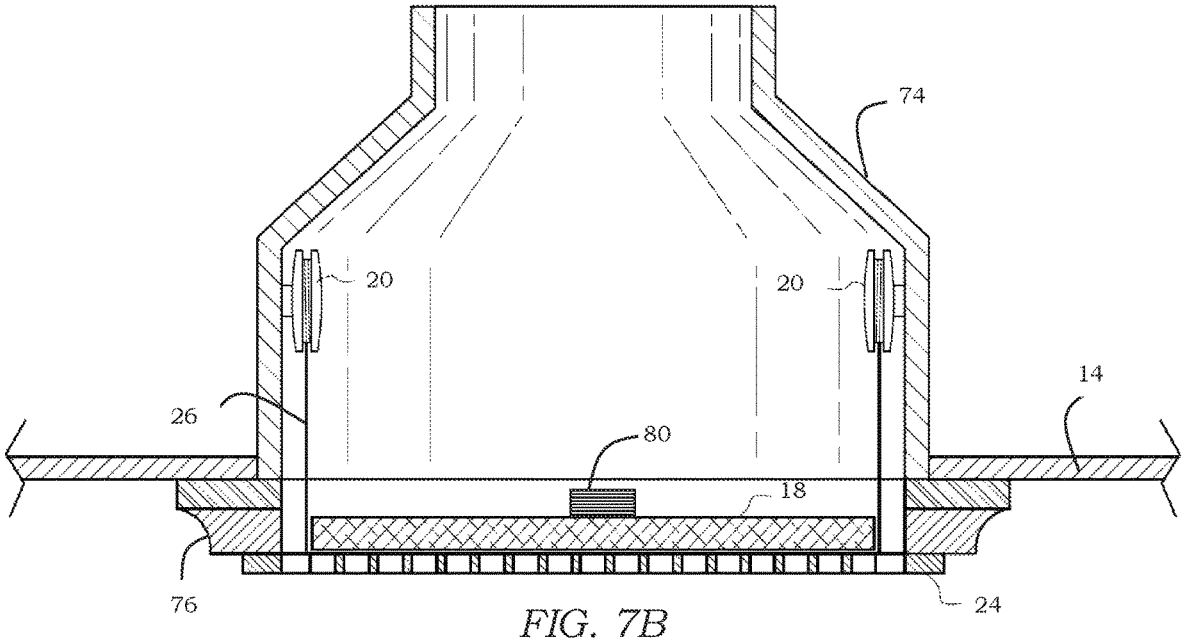
FIG. 7B depicts a cut-away view of an embodiment of the air return assembly in the first position when secured within an existing air duct.

FIGS. 7A and 7B depict an embodiment in which, return assembly 10 does not include frame 36 or flange 28. In such embodiments, retraction mechanisms 20 are coupled to the interior structure of existing air return assembly 74. To eliminate the need for flange 28, grille 24 includes trim piece 66 extending outwardly from grille 22. Trim piece 76 is configured to abut the interior surface of ceiling 14 when grille 22 is secured in the first position. Trim piece 76 may include gasket 78 disposed about the perimeter of trim piece 76 providing an airtight seal between the interior surface of ceiling 14 and trim piece 76. Gasket 78 ensures that air flowing within return assembly 10 only flows through grille 24 and is thereby filtered by air filter 18. In an embodiment, gasket 78 is formed of a compressible material to conform to details or imperfections of ceiling 14. To prevent air filter 18 from being disposed within existing air return assembly 74 during operation of the A/C system, beam 80 extends at least partially from first trim piece 76*a* to second trim piece 76*b*.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An air return grille assembly adapted to be installed within an air return opening having a first perimeter, the air return grille assembly comprising:

an air return housing including:

a frame establishing a housing channel and having a second perimeter sized smaller than the first perimeter of the air return opening, the frame including a first end, a second end, and a lateral wall extending therebetween, wherein the frame is configured to be at least partially disposed within the air return opening;

a flange extending inwardly from at least a portion of the lateral wall toward a centroid of the frame and configured to restrict an object from being disposed fully through the frame;

a retraction mechanism coupled to a portion of the lateral wall between the first end and the flange, the retraction mechanism including a link coupled to a grille and configured to transition the grille between a first position and a second position, wherein the retraction mechanism is biased toward the first position;

the grille having a third perimeter sized smaller than the second perimeter of the housing channel including:

a first surface, a second surface, and a body extending therebetween;

a slot disposed through the body from the first surface to the second surface and configured to permit airflow therethrough;

the grille configured to be at least partially received within the housing channel when in the first position ensuring that the object is secured between the grille and the flange of the air return housing when in the first position; and wherein upon exceeding the biasing force of the retraction mechanism, the grille is transitioned from the first position to the second position.

2. The air return grille assembly of claim 1, wherein the object is an air filter.

3. The air return grille assembly of claim 1, wherein the flange is discontinuous with the lateral interior wall.

4. The air return grille assembly of claim 1, wherein the flange includes a pass-through configured to permit the link of the retraction mechanism to be disposed through the flange.

5. The air return grille assembly of claim 1, further comprising:

a second flange extending inwardly from at least a portion of the lateral wall toward the centroid of the frame, the second flange disposed between the first flange and the second end of the air return housing, wherein the second flange is configured to abut the grille when in the first position.

6. The air return grille assembly of claim 5, wherein the second flange includes a magnet coupled to a surface the second flange and configured to be magnetically attracted to the grille when the grille is in the first position, thereby securing the retractable grille to the frame.

7. The air return grille assembly of claim 1, wherein the first end resides within a first plane and the second end resides within a second parallel plane.

8. The air return grille assembly of claim 1, wherein the retraction mechanism is a tension reel.

9. The air return grille assembly of claim 1, wherein the second surface of the grille includes a first attachment mechanism configured to couple to a second attachment mechanism of a tool, such that when the first and second attachment mechanisms are coupled together and the user exerts a downward force away from the air return grille assembly, the grille is transitioned from the first position to the second position.

10. An air return grille assembly adapted to be installed within an air return opening disposed within a ceiling, the air return opening having a first perimeter, the air return grille assembly comprising:

an air return housing including:

a frame establishing a housing channel and having a second perimeter sized smaller than the perimeter of the air return opening, the frame including a first end, a second end, and a lateral wall extending therebetween, wherein the frame is configured to be at least partially disposed within the air return opening;

a flange extending inwardly from at least a portion of the lateral wall toward a centroid of the frame and configured to restrict an air filter from being disposed fully through the frame;

a retraction mechanism coupled to a portion of the lateral wall between the first end and the flange, the retraction mechanism including a link coupled to a grille and configured to transition the grille between a first position and a second position, wherein the retraction mechanism is biased toward the first position;

the grille having a third perimeter sized smaller than the second perimeter of the housing channel, the grill including:

a first surface, a second surface, and a body extending therebetween;

a slot disposed through the body from the first surface to the second surface and configured to permit airflow therethrough;

the grille configured to be at least partially received within the housing channel when in the first position ensuring that the air filter is secured between the grille and the flange of the air return housing, when in the first position; and wherein upon exceeding the biasing force of the retraction mechanism, the grille is transitioned from the first position to the second position, such that when in the second position, the grille is disposed away from the housing channel of the frame.

11. The air return grille assembly of claim 10, wherein the flange is discontinuous with the lateral interior wall.

12. The air return grille assembly of claim 10, wherein the flange includes a pass-through configured to permit the link of the retraction mechanism to be disposed through the flange.

13. The air return grille assembly of claim 10, further comprising a second flange extending inwardly from at least a portion of the lateral wall toward the centroid of the frame, the second flange disposed between the first flange and the second end of the air return housing, wherein the second flange is configured to abut the grille when in the first position.

14. The air return grille assembly of claim 13, wherein the second flange includes a magnet coupled to a surface of the second flange and configured to be magnetically attracted to the grille when the grille is in the first position, thereby securing the grille to the frame.

15. The air return grille assembly of claim 10, wherein the first end resides within a first plane and the second end resides within a second parallel plane.

16. The air return grille assembly of claim 10, wherein the retraction mechanism is a tension reel.

17. The air return grille assembly of claim 10, wherein the second surface of the grille includes a first attachment mechanism configured to couple to a second attachment mechanism of a tool, such that when the first and second attachment mechanisms are coupled together, and the user exerts a downward force away from the air return grille assembly, the grille is transitioned from the first position to the second position.

18. An air return grille assembly adapted to be installed within an air return opening disposed within a ceiling, the air return opening having a first perimeter, the air return grille assembly comprising:

an air return housing including:

a frame configured to be at least partially disposed within the air return opening, the frame establishing a housing channel and having a second perimeter sized smaller than the perimeter of the air return opening, the frame including a first end opposite a second end, each of the first and the second ends defining an opening and a lateral wall extending therebetween, wherein the lateral wall includes a first and a second set of lateral surfaces in an orthogonal relationship with one another wherein the first set includes a first side opposite a second side and the second set includes a third side opposite a fourth side;

a first flange extending inwardly from at least a portion of the lateral wall toward a centroid of the frame and configured to restrict an air filter from being disposed fully through the frame;

a second flange extending inwardly from at least a portion of the lateral wall toward the centroid of the frame at a distance less than that of the first flange, the second flange disposed between the first flange and the second end of the air return housing, a magnet coupled to the second flange and configured to be magnetically attracted to the grille when the grille is in the first position thereby securing the retractable grille to the frame;

a retraction mechanism coupled to a portion of the lateral wall between the first end and the flange, the retraction mechanism including a link coupled to a grille and configured to transition the grille between a first position and a second position, wherein the retraction mechanism is biased toward the first position;

the grille having a third perimeter sized smaller than the second perimeter of the housing channel, the grill including:

a first surface, a second surface, and a body extending therebetween;

a slot disposed through the body from the first surface to the second surface and configured to permit airflow therethrough;

the grille configured to be at least partially received within the housing channel when in the first position ensuring that the air filter is secured between the grille and the flange of the air return housing when in the first position; and wherein upon exceeding the biasing force of the retraction mechanism, the grille is transitioned from the first position to the second position.

19. The air return assembly of claim 18, wherein the grille includes a trim piece extending outwardly from the second surface about the third perimeter, the trim piece configured to abut against a surface of the ceiling when the grille is in the first position.

20. The air return assembly of claim 19, wherein the trim piece further includes a gasket disposed about the trim piece, such that when the grille is in the first position the trim piece forms an airtight seal with the surface of the ceiling, thereby ensuring that air flowing from a first space to the air return opening must pass through the air filter.

* * * * *